United States Patent [19]

Reed, Jr.

[11] Patent Number: 4,705,255

[45] Date of Patent: Nov. 10, 1987

[54] TWIST LOCK INVERTED T-RAIL CLIP

[75] Inventor: Gueary T. Reed, Jr., Lee County, Miss.

[73] Assignee: Emerson Electric Co., St. Louis, Mo.

[21] Appl. No.: 696,008

[22] Filed: Jan. 29, 1985

[51] Int. Cl.[4] ..... A47H 1/10

[52] U.S. Cl. ..... 248/317; 248/221.4

[58] Field of Search ..... 248/317, 228, 343, 342, 248/344, 222.3, 221.4, 221.3; 24/590, 595

[56] References Cited

U.S. PATENT DOCUMENTS

| | | | |
|---|---|---|---|
| 1,704,990 | 3/1929 | Pierce | 248/317 UX |
| 1,878,084 | 9/1932 | Winkler | 248/343 |
| 2,000,241 | 5/1935 | Mavgin | 248/342 X |
| 2,541,828 | 2/1951 | Peck | 248/221.4 |
| 2,719,374 | 10/1955 | Paione | 248/317 X |
| 2,736,528 | 2/1956 | Brock | 248/317 |
| 3,003,735 | 10/1961 | Havener | 248/228 |
| 3,061,258 | 10/1962 | Grenier | 248/221.4 |
| 3,118,621 | 1/1964 | Bailey | 248/221.3 X |
| 3,374,979 | 3/1968 | Colchen et al. | 248/221.4 |
| 3,589,660 | 6/1971 | Dunckel | 248/343 |
| 3,601,862 | 8/1971 | Haigadon | 248/317 X |
| 3,743,228 | 7/1973 | Diab | 248/228 |
| 3,780,973 | 12/1973 | Dalton, Jr. | 248/317 X |
| 4,191,352 | 3/1980 | Schuplin | 248/317 |
| 4,230,297 | 10/1980 | Comer | 248/317 |
| 4,522,541 | 6/1985 | Bidwell | 24/590 |

FOREIGN PATENT DOCUMENTS

| | | | |
|---|---|---|---|
| 2001074 | 7/1971 | Fed. Rep. of Germany | 248/221.4 |
| 539640 | 9/1941 | United Kingdom | 248/221.4 |

OTHER PUBLICATIONS

Caddy Twist Clips, Erico Products Catalog, Cleveland, Ohio 1973.

*Primary Examiner*—Ramon S. Britts
*Assistant Examiner*—Sarah A. Lechok Eley
*Attorney, Agent, or Firm*—Polster, Polster and Lucchesi

[57] ABSTRACT

A one-piece spring steel metal clip includes an upper portion which twists onto an inverted T-rail and a lower saddle portion which snaps into a hole in the upper wall of a lighting fixture. The clip may slide along the inverted T-rail to a desired position and also permits the fixture to swivel to a desired orientation.

21 Claims, 5 Drawing Figures

TWIST LOCK INVERTED T-RAIL CLIP

BACKGROUND OF THE INVENTION

This invention relates to a clip for suspending a lighting fixture or other devices from a suspended ceiling.

Suspended ceilings are now in common use. Such ceilings consist of a grid of rails supporting rectangular panels which define the ceiling. Most commonly, the rail is in the form of an inverted T, having a head from which the rail is suspended from a superstructure, a vertical web, and a flat flange base on which the panels rest. Lighting fixtures are either recessed in the plenum above the suspended ceiling or are suspended from the grid. In the latter case, a bracket is clipped onto the base of the T-rail, and a depending hanger part is attached to the fixture.

In U.S. Pat. No. 3,003,735, to Havener, the upper part of a suspension clip twists onto the base of the T-rail. A depending threaded stud is mounted on the clip. Two clips are mounted on either a single T-rail or on adjacent T-rails, in accordance with the desired orientation of the fixture. The fixture is then opened and the studs are extended into knock-out openings in the fixture. A nut is threaded onto each stud from within the fixture, and the fixture is closed. This approach uses several loose parts, requires considerable labor, and is dependent on adequate tightening of the nuts to ensure that the fixture does not work loose.

In U.S. Pat. No. 3,589,660, to Dunckel, a single piece hanger is disclosed. This hanger has an upper part which clips onto the base of the T-rail and a pair of depending wing portions which clip around the entire fixture. This approach avoids the disadvantages of the prior clip, but it introduces other limitations. It requires a massive hanger structure to embrace the fixture, and the size of the wings must be tailored to specific fixtures. Two sets of attachments must be provided on the upper part of the hanger to support the fixture either parallel with or perpendicular to the supporting rail or rails. To provide other, angular, orientations with respect to the supporting rails, the wing portions must be pivoted to the clip portion.

The invention is also directed more generally to clips for supporting objects from suspended ceilings. In many environments it is desirable to support objects such as planters or signs from suspended ceilings. Presently known clips for such purposes are awkward and unsightly.

SUMMARY OF THE INVENTION

One of the objects of this invention is to provide a low-cost clip for suspending lighting fixtures.

Another object is to provide such a clip which is easily mounted to an inverted T-rail.

Another object is to provide such a clip which positively grips a lighting fixture and reliably supports substantial weights.

Another object is to provide such a clip which permits lighting fixtures to be supported at any angle with respect to the supporting T-rail.

Another object is to provide such a clip which is extremely simple to install and which permits quick and simple installation of lighting fixtures.

Another object is to provide such a clip which is adapted to support lighting fixtures of different sizes.

Another object is to provide such a clip which is compact and attractive and which may support objects other than lighting fixtures.

Other objects will occur to those skilled in the art in light of the following description and accompanying drawings.

In accordance with this invention, generally stated, a one-piece clip is provided for supporting a lighting fixture or the like, the clip including an upper part for attachment to a rail structure and a depending lower part integral with the upper part. The lower part includes a portion which extends through an opening in the upper wall of the fixture and springs outwardly to engage the edge of the opening.

In the preferred embodiment, the clip is formed from a piece of spring steel. The upper part includes a pair of diagonally opposed folded flanges for engaging the T-rail flange base, and a pair of diagonally opposed upturned edges for preventing the inadvertent removal of the clip from the T-rail. The lower part of the clip includes a pair of downwardly extending legs attached to the upper part, a web part connecting the legs, and a pair of arms extending upwardly from the web part. The downwardly extending legs and upwardly extending arms form a generally square box structure which extends into an opening in the upper wall of the lighting fixture. The arms are canted upwardly outward, and are compressed slightly as the box structure is pushed into the opening. The arms include outwardly turned corners which spring outward beyond the periphery of the opening to lock the fixture to the clip. An upwardly extending stop portion of the arms limits outward movement of the arms after the clip is pushed into the opening.

Other aspects of the invention will best be understood in view of the following description of the preferred embodiment.

DESCRIPTION OF THE PREFERRED EMBODIMENT

Figure 1:
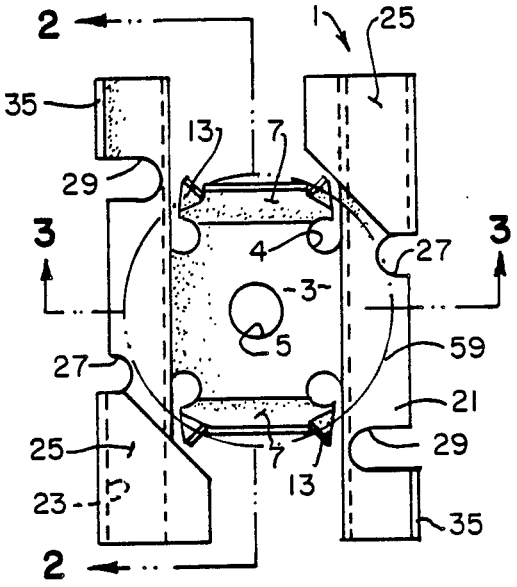
FIG. 1 is a top plan view of one illustrative embodiment of clip of the present invention.
Figure 2:
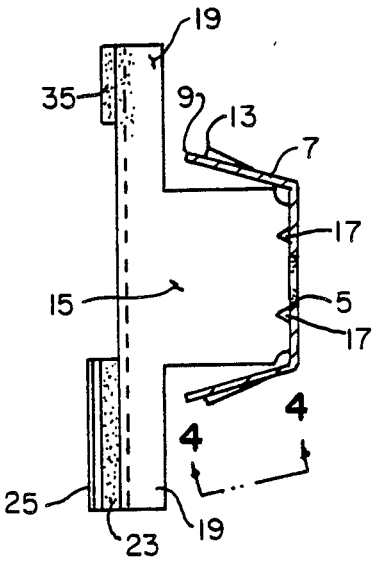
FIG. 2 is a sectional view taken along the line 2—2 of FIG. 1.
Figure 3:
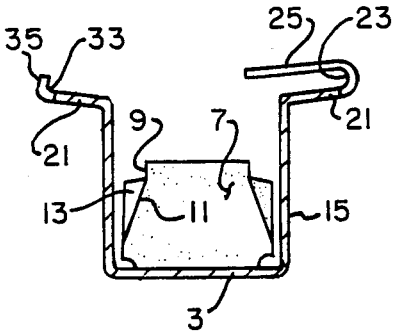
FIG. 3 is a sectional view taken along the line 3—3 of FIG. 1.
Figure 4:
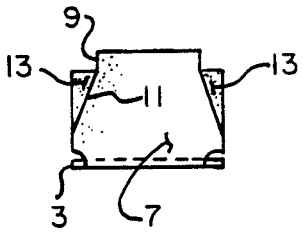
FIG. 4 is a detail taken along the line 4—4 of FIG. 2.

Referring now to the drawings, reference numeral 1 indicates one illustrative embodiment of twist lock inverted T-rail clip of the present invention. The clip 1 is formed from a single piece of 0.025" tempered spring steel.

The lowermost part of the clip 1 is a square horizontal web 3, having an inside dimension of 0.562" on a side. The web 3 has a central hole 5, having a diameter of 0.156". The corners of the web 3 are provided with circular relief holes 4, spaced 0.281" from the center of the web 3.

The opposed ends of the web 3 are cut to a width of 0.500" and are bent upward and outward to form arms 7. The arms 7 are 0.359" tall and their free upper ends are spaced apart 0.800", thereby forming an angle of about 109° with respect to the web 3. At the free ends of the arms 3, the corners of the arms 3 are cut away to form a central tongue 9. The tongue 9 has a width of 0.343" and is height of 0.062". On either side of the tongue 9, the arms 7 are bent outward 30° from the plane of the arms, along lines indicated at 11, to form ears 13. The ears 13 have a height of 0.203".

The opposed sides of the web 3 are bent upward at ninety degrees to the plane of the web, to form legs 15. The legs 15 have a width of 0.562". Embossments 17 are provided at the juncture of web 3 and legs 15, to stiffen the clip 1.

The portion of the clip 1 thus far described forms a lower section of the clip 1, for attachment of the clip 1 to a lighting fixture or the like, as hereinafter described. The upper section of the clip, described below, is for attachment of the clip 1 to a structure such as an inverted T-rail.

The free upper ends of the legs 15 are elongated to form shoulders 19 having an overall length of 1.50". The lower edges of the shoulders 19 are spaced outboard of and 0.122" above the upper edges of the ears 13 on the arms 7.

The upper end of each leg 15 (including its shoulders 19) is bent outward to form a ledge 21. The height of each leg 15 is 0.563" from the lower surface of the web 3 to the lower surface of the ledge 21, and each shoulder portion is 0.136" tall from its lower edge to the lower surface of the ledge 21. The ledges 21 form an angle of 95° with the legs 15. The ledges 21 are notched and bent in a manner which is point-symmetrical about the center of the clip 1, to permit the clip 1 to be twisted onto the flat flange base of the T-rail as described hereinafter.

One end of each ledge 21 is bent inwardly, as indicated at 23, to form an attachment flap 25. The attachment flaps 25 extend inwardly 0.313" and have a length of 0.50". Their inner corners are cut off at a 45° angle, beginning at a point spaced 0.078" from the fold line 23. The attachment flaps are parallel with the ledges 21 and are spaced 0.070" from the ledges 21. At the edge of each attachment flap 25, a 0.125" relief hole 27 extends 0.100" into the ledge 21, to provide a degree of independent flexure for the attachment flaps 25.

The other two diagonally opposed corners of the ledges 21 are provided with 0.125" relief holes 29 extending 0.194" into the ledge 21, to provide an end tab 31 which can be flexed independent of the rest of the ledge 21. The free edge of the end tab is turned upward 0.062", as indicated at 33, to form a small finger 35.

The distance between the attachment flap fold 23 and the finger fold 33 is precisely one inch. It will, of course, be appreciated that the distance between the two ledge portions 21 will vary somewhat as the legs 15 are spread or pushed together.

Figure 5:
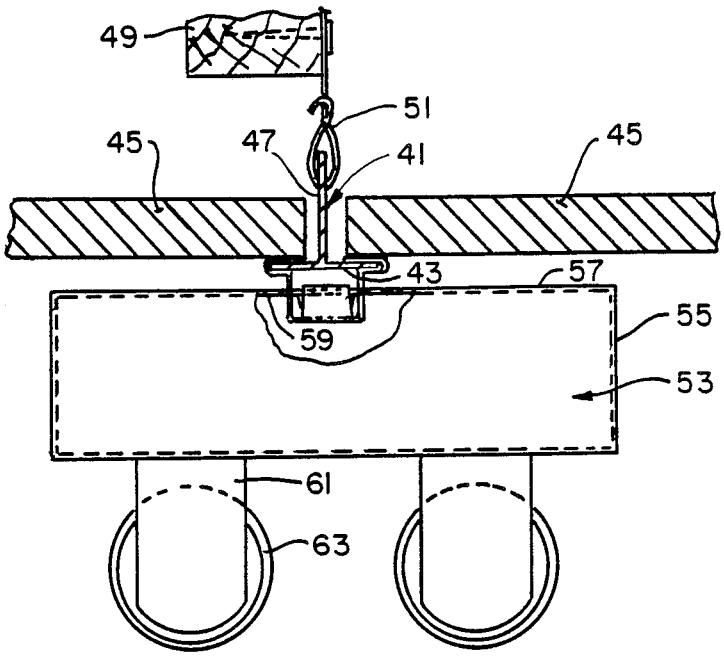
FIG. 5 is an end view, partially broken away, of a lighting fixture suspended from a suspended ceiling by the clip of FIGS. 1–4.

The attachment of the clip 1 to an inverted T-rail and the attachment of a lighting fixture to the clip 1 is shown in FIG. 5.

As shown in FIG. 5, the T-rail 41 includes a horizontal flange base 43 which supports ceiling panels 45. The vertical web 47 of the T-rail 41 is mounted to a joist 49 by a wire tie 51. This is a standard construction.

The clip 1 is attached to the inverted T-rail 41 by slipping one attachment flap 25 over one side of the T-rail's horizontal flange base 43, with the clip turned about thirty degrees with respect to the T-rail 41. The other attachment flap 25 is then slipped over the other side of the T-rail's horizontal flange base 43, and the clip is turned parallel with the T-rail 41. The fingers 35 snap over the edges of the horizontal flange base of the T-rail and lock the clip onto the T-rail. The T-rail's flange base 43 fits snugly between the clip's attachment flaps 25 and its ledges 21 and causes the ledges 21 to form more nearly a 90° angle with the legs 15. The standard one-inch width of the T-rail's horizontal flange base provides a slight amount of play when the ledges 21 are straightened to a more nearly coplanar orientation by the flange. When the clip 1 is attached to the T-rail 41, it is may be slid along the T-rail 41 by firm hand force.

A standard lighting fixture 53 includes a sheet metal body part 55 having an upper wall 57. In the wall 57 are two round holes 59 located on the longitudinal axis of the fixture 59 and spaced from each other. The holes are in the form of 0.875" knockouts. Lamp holders 61 depend from the ends of the fixture 53. Lamps 63 are carried by the holders 61.

Without opening the sheet metal body part 55, the knockouts are removed to form the holes 59.

Two clips 1 are positioned in the desired positions to hold the lighting fixture 53. The clips may be placed on a single T-rail as shown in FIG. 5 to align the fixture 53 with that T-rail, or they may be placed on adjacent parallel T-rails to align the fixture 53 perpendicular to the supporting T-rails, or (less commonly) they may be placed on abutting rails to position the fixture at an angle to the grid of T-rails. The fixture is then positioned with the holes 59 adjacent the lower portions of the clips 1. The fixture is then pushed onto the clips 1. The arms 7 of the clip 1 are compressed slightly as they are pushed into the holes 59, as may be seen from the phantom line representation of the hole 59 in FIG. 1, showing the size of the hole 59 in comparison with the unstressed clip 1. As the ears 13 pass the lower edge of the wall 57, the arms 7 spring out, and the portion of the upper wall 57 around the hole 57 rests on the upper edges of the ears 13. This mounting operation may be carried out entirely without tools and without the use of any parts other than the one-piece clips 1.

It has been found that the clips 1 provide a remarkably secure mounting for the fixture 53. Without the application of outside pressure, the clips do not shift on the T-rails 41. The clips routinely pass a two hundred pound pull-out test on the fixture 53. Removing the clips 1 from the fixture requires disassembly of the fixture body 55 to permit the arms 7 to be compressed. The clip 1 is then removable from the T-rail by twisting it. If only one clip 1 is removed, the fixture 59 may be pivoted around the other clip to a new orientation, if its wiring permits.

Numerous variations in the mounting clip of the present invention, within the scope of the appended claims, will occur to those skilled in the art in light of the foregoing disclosure. Merely by way of example, the lower portion of the clip may be made to other sizes to accommodate holes of different sizes, and the upper portion of the clip may be made to other sizes to accommodate T-rails or other support structures of different forms or sizes. The clip may be utilized to support other devices than lighting fixtures. Those which have holes in their upper walls may be supported in the same manner as the lighting fixture of the preferred embodiment; other devices may be supported by studs through the hole 5 or by wires through the holes 4 and 5. The size and shape of the arms 7 and the legs 15 may be altered for particular purposes, as for example to space the fixture 53 farther from the ceiling panels 45. Many of the advantages of the clip may be retained even with substantial modifications of either the upper portion or the lower portion, as by putting ears on the legs 15 and eliminating the arms 7. These variations are merely illustrative.

I claim:

1. A one-piece clip for supporting a lighting fixture or the like from a support structure, the clip including an upper part, said upper part including means for attaching the clip to the structure and a depending lower part integral with the upper part, the lower part comprising attachment means for extending through an opening in the upper wall of the fixture and springing outwardly to engage the edge of the opening. the attachment means comprising a pair of generally vertical legs attached to the upper part, a web part connecting the legs, and a pair of arms extending upwardly and outwardly from the web, the arms being proportioned to be compressed slightly as the attachment means are pushed into the opening.

2. The clip of claim 1 wherein the clip is formed of spring steel.

3. The clip of claim 1 wherein the upper part comprises a pair of diagonally opposed folded flanges for engaging a T-rail flange base and a pair of diagonally opposed upturned edges for preventing the inadvertent removal of the clip from the T-rail.

4. The clip of claim 1 wherein the legs and upwardly extending arms form a generally square box structure proportioned to extend into the opening in the upper wall of the fixture.

5. The clip of claim 4 wherein the arms include outwardly turned ears which spring outward beyond the periphery of the opening to lock the fixture to the clip.

6. The clip of claim 5 wherein the arms further include an upwardly extending stop portion for limiting outward movement of the arms after the clip is pushed into the opening.

7. In combination, a fixture having an upper wall and at least one hole in the upper wall, and a clip for holding the fixture to a support structure, the clip being formed of a single piece of sheet material, the clip comprising an upper part, said upper part including structure-engaging means for attaching the clip to the support structure, and a depending lower part, the lower part comprising a pair of legs attached to the upper part, a web part connecting the legs, and a pair of arms extending upwardly from the web part, the pair of upwardly extending arms having free upper ends, the legs extending through the opening in the upper wall of the fixture and the arms engaging a lower face of the upper wall of the fixture to hold the fixture to the clip.

8. The combination of claim 7 wherein the clip is formed of spring steel.

9. The combination of claim 7 wherein the upper part of the clip comprises a pair of diagonally opposed folded flanges for engaging a T-rail flange base and a pair of diagonally opposed upturned edges for preventing the inadvertent removal of the clip from the T-rail.

10. The combination of claim 9 wherein the upper part of the clip comprises a pair of ledges forming outwardly bent extensions of the pair of legs.

11. The combination of claim 10 wherein the legs and upwardly extending arms form a box structure extending into the opening in the upper wall of the fixture, the arms including outwardly turned ears which spring outward beyond the periphery of the opening to lock the fixture to the clip.

12. The combination of claim 11 wherein the arms are canted upwardly outward, and are proportioned to be compressed slightly as the box structure is pushed into the opening.

13. A one-piece clip for supporting a fixture from an overhead rail structure, the clip comprising a web portion, a pair of legs extending upwardly from opposed ends of the web portion, a pair of ledges forming outwardly bent extensions of the pair of legs at their free upper ends, a pair of diagonally opposed folded flanges, one on each of the ledges, for engaging a T-rail flange base, and a pair of diagonally opposed upturned edges, one on each of the ledges, for preventing the inadvertent removal of the clip from the T-rail; the clip further comprising means for supporting the fixture.

14. The clip of claim 13 wherein the means for supporting the fixture are carried by the web portion for mounting the fixture to the clip.

15. The clip of claim 14 wherein the means for supporting the fixture comprise a pair of upwardly extending arms, the arms being canted upwardly outward, and being proportioned to be compressed slightly as the web portion is pushed into an opening in an upper wall of the fixture.

16. The clip of claim 15 wherein the arms include outwardly turned ears which spring outward beyond the periphery of the opening to lock the fixture to the clip.

17. The clip of claim 16 wherein the arms further include an upwardly extending stop portion for limiting outward movement of the arms after the clip is pushed into the opening.

18. The clip of claim 16 wherein the rail engaging means comprises a pair of diagonally opposed folded flanges, one on each of the ledges, for engaging a T-rail flange base and a pair of diagonally opposed upturned edges, one on each of the ledges, for preventing the inadvertent removal of the clip from the T-rail.

19. The clip of claim 15 further including at least one hole in the web for mounting devices to the clip.

20. The clip of claim 13 wherein the clip is formed of spring steel.

21. In combination, an overhead rail structure, a lighting fixture and a one-piece clip for supporting the fixture from the overhead rail structure, the clip comprising a generally rectangular web portion having a pair of opposed ends and a pair of opposed sides, a pair of legs extending upwardly from the opposed ends of the web portion, the legs including means engaging the overhead rail structure to hold the clip to the rail structure, and a pair of arms extending upwardly from the opposed sides of the web portion, the arms including means engaging the fixture to hold the fixture to the clip.

* * * * *